US005915314A

United States Patent [19]

Moore, III

[11] Patent Number: 5,915,314

[45] Date of Patent: Jun. 29, 1999

[54] CURVED ARTICLE SEWING FRAME AND DRIVE SYSTEM

[76] Inventor: E. Frank Moore, III, 8013 Walker Mill Rd., Randleman, N.C. 27317

[21] Appl. No.: 08/692,538

[22] Filed: Jul. 31, 1996

[51] Int. Cl.[6] ..... D05C 9/04

[52] U.S. Cl. ..... 112/103; 112/470.18

[58] Field of Search ..... 112/102.5, 103, 112/470.18, 470.14; 38/102.2, 102.91

[56] References Cited

U.S. PATENT DOCUMENTS

| | | | |
|---|---|---|---|
| 4,665,844 | 5/1987 | Shibata | 112/103 |
| 4,998,964 | 3/1991 | Golia | 112/121 |
| 5,507,241 | 4/1996 | Evans | 112/470.18 |
| 5,553,560 | 9/1996 | Tajima et al. | 112/103 |
| 5,590,613 | 1/1997 | Head | 112/103 |

FOREIGN PATENT DOCUMENTS

| | | | |
|---|---|---|---|
| 4139756 | 6/1993 | Germany | 38/102.91 |

OTHER PUBLICATIONS

Pending design application Serial No. 29/043,667 filed Sep. 8, 1995.

Photographs of Prior Art Sewing Frame and Drive System (undated).

*Primary Examiner*—Ismael Izaguirre

[57] ABSTRACT

A sewing frame and drive system is provided for use generally on commercial sewing/embroidery machines. The invention provides a sewing frame which is releasably attached to the sewing machine through a drive system for use with curved articles such as baseball caps. The drive system allows the sewing frame to laterally move and to rotate approximately 300° whereby substantial embroidering can be conducted on the sides as well as the front of the cap. The sewing frame includes clips which tension the soft fabric of the hats against a biasly mounted clip base.

16 Claims, 6 Drawing Sheets

CURVED ARTICLE SEWING FRAME AND DRIVE SYSTEM

FIELD OF THE INVENTION

The invention herein pertains to machine embroidering and particularly pertains to embroidering caps and other curved fabric articles on multi-head sewing machines.

DESCRIPTION OF THE PRIOR ART AND OBJECTIVES OF THE INVENTION

With the increased use of multi-head sewing/embroidering machines in recent years, the demand for embroidering on arcuate surfaces such as on baseball and other caps has greatly increased. Many devices and methods have been utilized for converting a flat bed embroidering machine to enable it to sew on a curved surface have been developed such as set forth in U.S. Pat. Nos. 4,998,964 and 4,665,844. These devices and others generally include a mechansim for attaching a cylindrically-shaped cap frame to the embroidery machine along with a mechanism to rotate the cap during the embroidery process. Such mechanisms generally allow the cap frame to partially rotate around a central axis, the rotation being generally no more than 120°.

During embroidering, the stitches apply tension to the fabric which can distort the fabric, thus a complex, multi-colored pattern may lose registration if the fabric is not tightly held in place. To prevent misaligned stitches or incorrect registration, conventional embroidering machines have utilized "boardy" fabrics, cardboard inserts or reinforced or "sized" fabrics to prevent tension variations and registration errors during the embroidering process.

Thus with the problems and disadvantages associated with prior art embroidering techniques on curved fabric surfaces such as on baseball caps, the present invention was conceived and one of its objectives is to provide a sewing frame for caps and the like and a drive system for use with conventional multi-head embroidering machines which is easy to install and use.

It is another objective of the present invention to provide a sewing frame which is adjustable for different sizes and types of caps or other curved articles.

It is yet another objective of the present invention to provide a sewing frame for use on embroidering machines which includes an adjustable clip base and gathering clips for properly tensioning the fabric of the article to be embroidered.

It is a further objective of the present invention to provide a sewing frame which can be easily and conveniently removed and attached to a drive system as needed.

It is also an objective of the present invention to provide a drive system for a sewing frame which can be easily affixed to a conventional embroidery machine by unskilled workers.

It is also an objective of the present invention to provide a drive system which includes a mounting plate, a flexible band loop, and a frame drive, the frame drive being rotated by the movement of the band loop.

It is yet a further objective of the present invention to provide a sewing frame drive system which is laterally moveable by means of bushings engaging slide rods.

Various other objectives and advantages of the present invention will become apparent to those skilled in the art as a more detailed description thereof is set forth below.

SUMMARY OF THE INVENTION

The aforesaid and other objectives are realized by providing a sewing frame which is releasably attachable to a drive system for sewing and/or embroidering purposes. A conventional commercial multi-head embroidering machine can be easily converted from use with flat goods, such as shirts, trousers, jackets or the like, to curved goods such as baseball caps by removing a portion of the sewing table and fitting each of a plurality of frame drive systems below each of the sewing heads. The sewing frame drive system includes a mounting plate and bracket for attachment to the sewing/embroidering machines and includes means for rotating the curved article and for laterally driving the curved article for precise movement while completing the programmed embroidery pattern. The drive system includes a conventional looped drive band and a novel frame drive plate with bushing pairs to accommodate the lateral movement. The sewing frame for retaining a baseball cap or other arcuate fabric includes a clip base and removable gathering clips which allow the operator to manually tighten the cloth which along with article clamps, allows the operator to tighten the cap thereon to obtain near-perfect registration during complex embroidering. The fabric sewing frame can be quickly exchanged for another with an unembroidered cap after the embroidering is completed by the use of a tensioned locking mechanism affixed to the frame drive cylinder of the drive system.

DESCRIPTION OF THE PREFERRED EMBODIMENT AND OPERATION OF THE INVENTION

Figure 1:
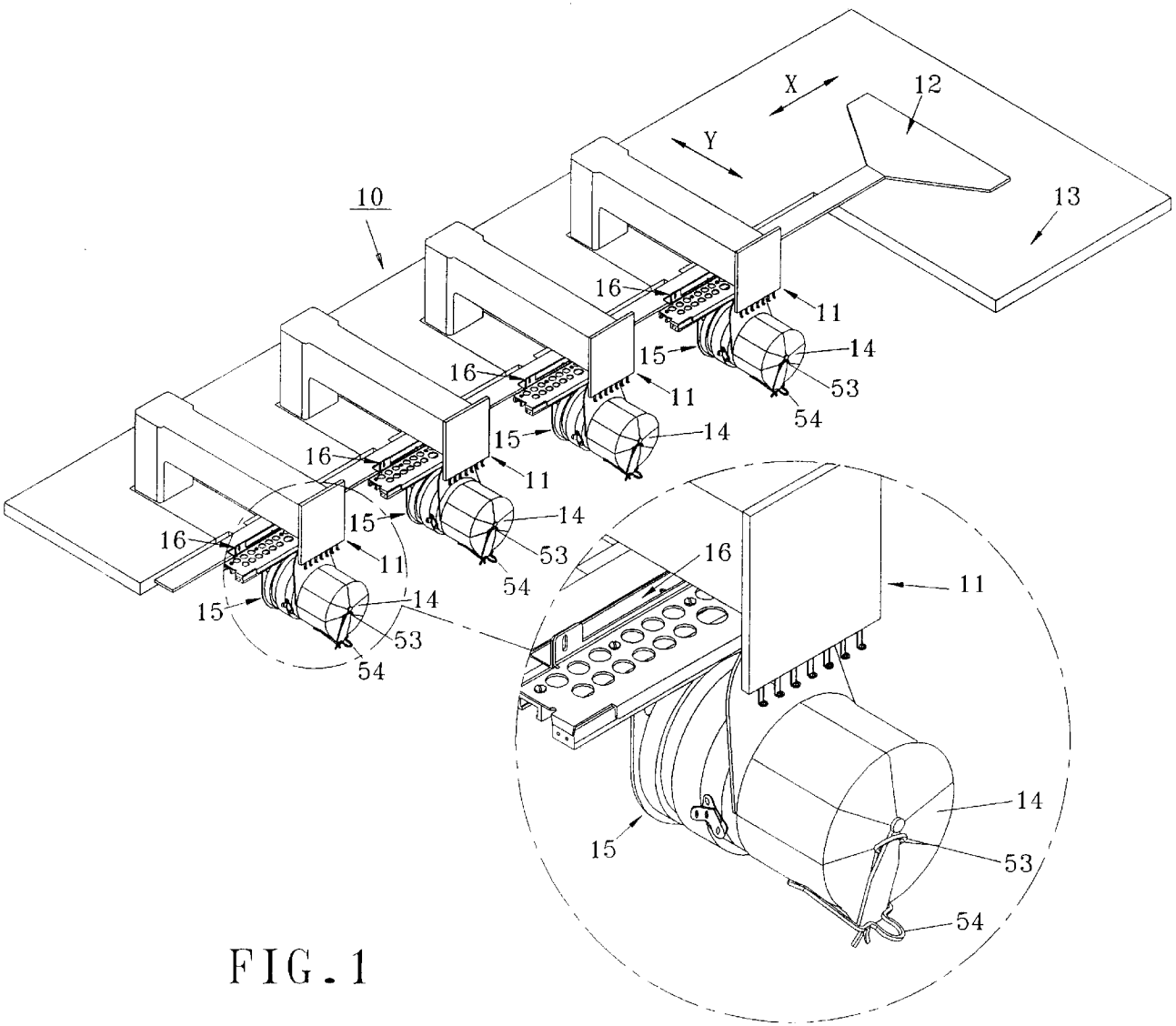
FIG. 1 illustrates a schematic representation of a conventional computer controlled commercial multi-head sewing/embroidering machine which has been converted for embroidering on curved articles, with one head enlarged for observation purposes.
Figure 2:
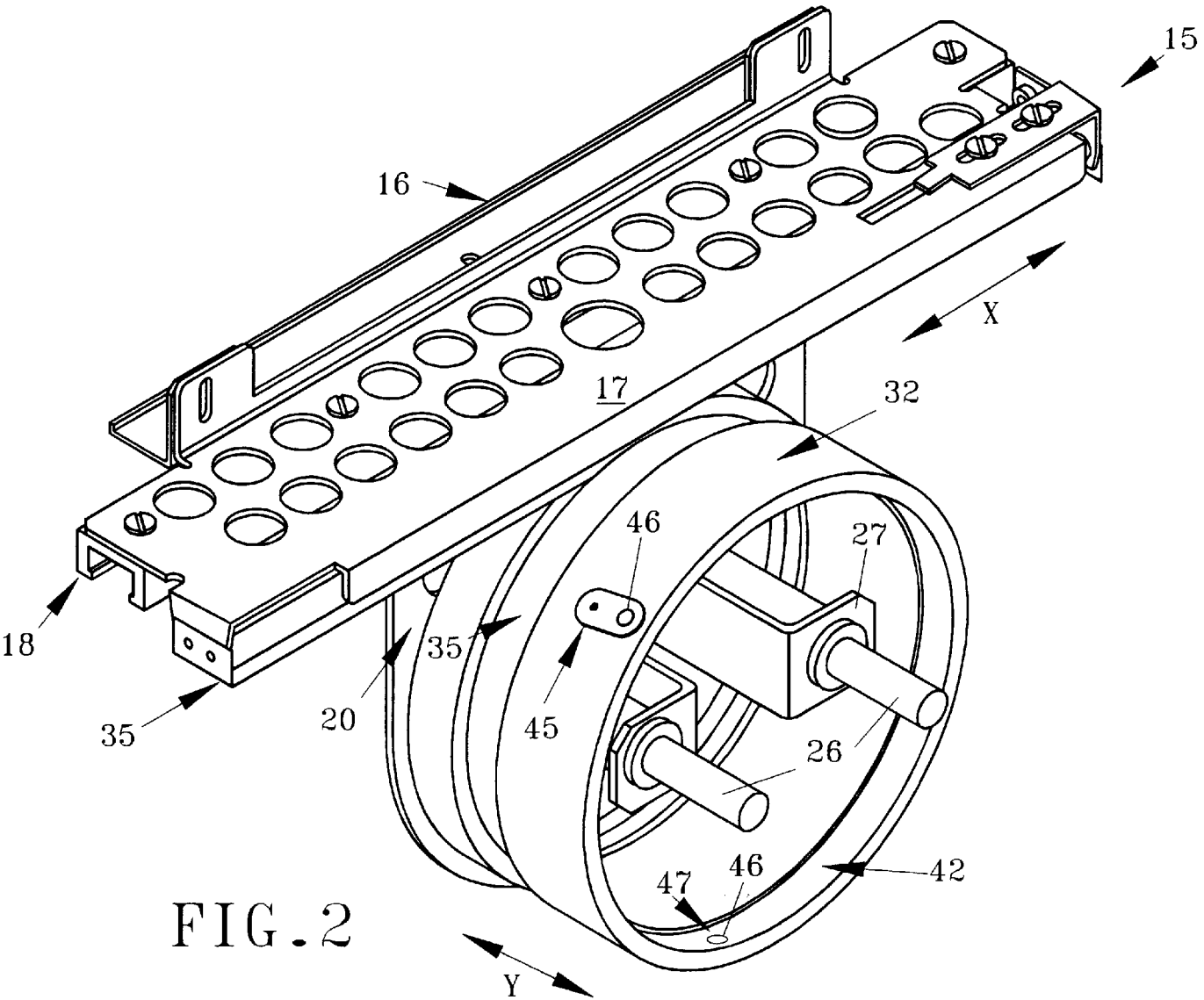
FIG. 2 demonstrates an enlarged view of the novel drive system as used in FIG. 1.
Figure 3:
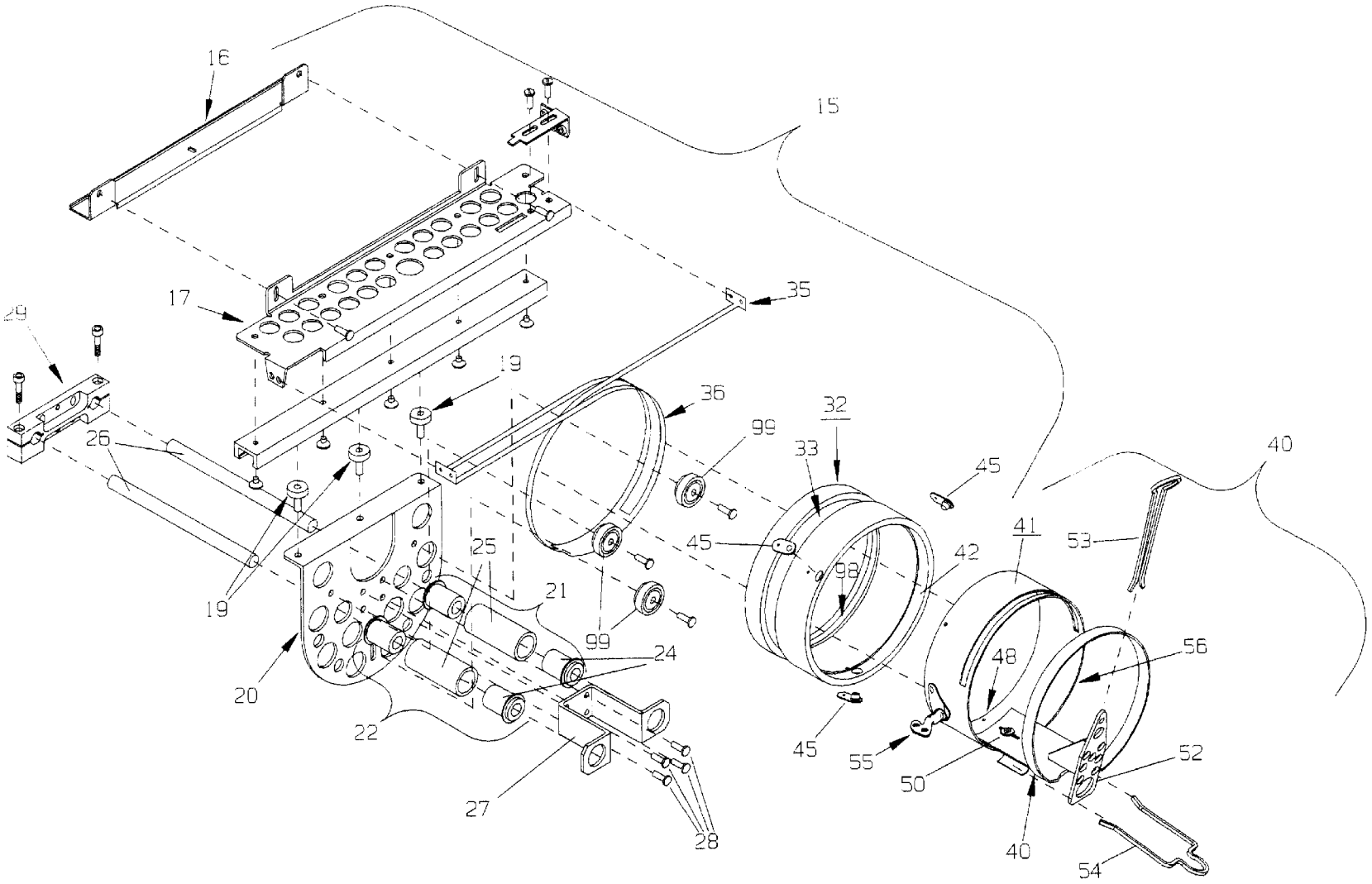
FIG. 3 provides an exploded view of the drive system as seen in FIG. 2 with the fabric frame.

For a better understanding of the invention and its operation, turning now to the drawings, FIG. 1 illustrates a schematic representation of a conventional commercial multi-head sewing/embroidering machine 10 having four sewing heads 11 with a programmable computer driven pantograph 12 positioned on table 13 which has been modified to accommodate curved goods such as baseball caps 14 shown thereon. In the preferred form shown in FIG. 1, sewing frame drive system 15 is attached to table 13 by rear bracket 16 such as by screws or the like, as seen in FIGS. 2 and 3. Rear bracket 16 is joined to mounting plate 17 by screws or other conventional fasteners and includes raceway 18 formed from a conventional, durable polymeric material. Rollers 19 (FIG. 3) are mounted atop frame drive plate 20 and are contained within raceway 18 to allow longitudinal movement for sewing frame drive system 15 seen enlarged in FIG. 2. Frame drive plate 20 retains bushing assemblies 21, 22 which include bushing sections 23, 24 which are contained within sleeve 25. Bushing sections 23, 24 contain ball bearings for rotation along slide rods 26. U-shaped bracket 27 stabilizes bushing assemblies 21, 22 and is affixed to frame drive plate 20 by screws 28, as shown in detail in FIG. 3. Slide rods 26 are rigidly affixed by bracket 29 beneath table 13. Thus, bushing sections 23, 24 allow lateral movement (shown by arrow Y in FIG. 1) of sewing frame drive system 15 while flexible stainless steel band 35 which includes a movable loop 36 provides longitudinal movement (X direction) of frame drive cylinder 32. Frame drive system 15 includes frame drive cylinder 32 as shown in FIG. 3 which is formed from durable plastic or other suitable materials. Frame drive cylinder 32 defines an outer groove 33 for reception of flexible stainless steel band 35 therein. Thus, as loop 36 moves from left to right and right to left along mounting plate 17 to which it is attached, frame drive cylinder 32 rotates therealong approximately 300° around slide rods 26 disposed within. In addition, frame drive cylinder 32 moves laterally along slide rods 26 as required to accommodate various embroidery patterns, as directed by programmed pantograph 12. A trio of frame drive rollers 99 are mounted to frame drive plate 20 to contact frame drive cylinder 32. Frame drive cylinder 32 defines interior race 98, within which are mounted frame drive rollers 99.

A ball cap, such as cap 14, is held by cap frame 40 (FIG. 1) detachably affixed to frame drive cylinder 32 as first arcuate section 41 is slidably received within terminal groove 42 on the interior of frame drive cylinder 32. Groove 42 (FIG. 2) has an axial width of approximately 13 mm and an approximate depth of 4 mm. Positioned on the exterior periphery of frame drive cylinder 32 is resilient locking mechanism 45. Mechanism 45 is downwardly biased to force locking stud 46 into groove 42. A plurality of locking studs 46 are each contained within one of apertures 47 which may be spaced equidistance around drive cylinder 32. Thus, as locking mechanism 45 is urged against drive cylinder 45, locking studs 46 protrude through apertures 47 and penetrate coincidentally aligned openings 48 in first arcuate section 41 of fabric frame 40 (FIG. 4) to thus releasably retain fabric frame 40 on frame drive cylinder 32. Likewise, by manual lateral urging of fabric frame 40, frame 40 can be easily detached from drive cylinder 32 for removal of the embroidered cap and for positioning another cap or article thereon.

Figure 4:
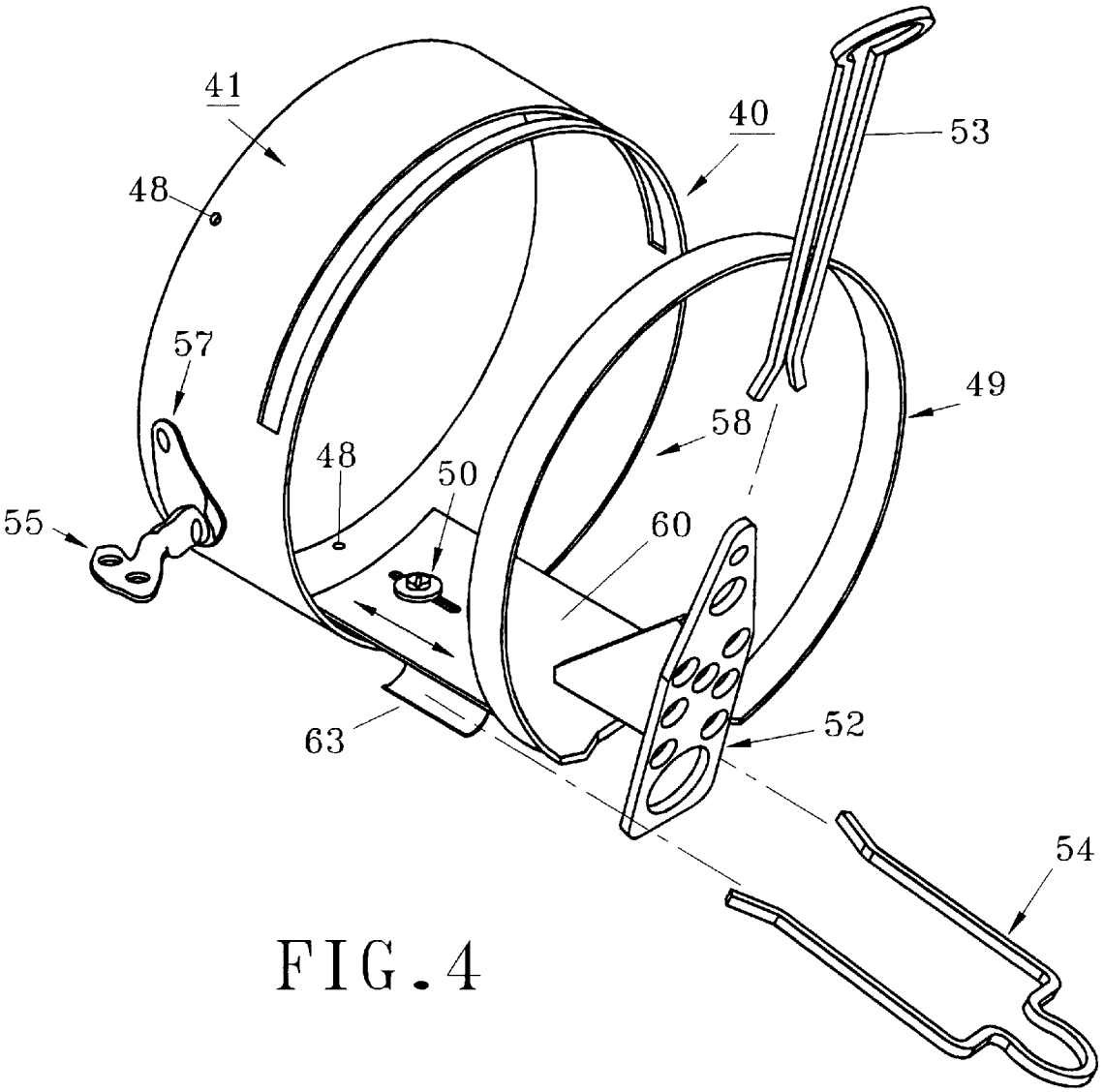
FIG. 4 pictures enlarged perspective view of the fabric frame as seen in FIG. 3.

Fabric frame 40, formed from stainless steel in the preferred embodiment, includes first arcuate section 41, and second arcuate section 49. Second arcuate section 49 is adjustably, axially spaced from first arcuate section 41 and is secured in place such as by wing nut 50 or the like. Second arcuate section 49 is attached to depending extension 60 which is slotted. Extension 60 is curved to slidably engage first arcuate section 41. Nut 50 is threadably received on bolt 61 passing through slot 62 to allow adjustable movement or spacing between first arcuate section 41 and second arcuate section 49 for caps of different heights. Also affixed to second arcuate section 49 is clip base 52. Clip base 52 is biasly mounted as shown in FIG. 4 to allow stainless steel wire gathering clip 53 to pass thereover to tension fabric thereon. Thus, clip 53 pulls the top of a conventional baseball cap tightly around clip base 52 to ensure proper registration during embroidering. An additional gathering clip 54 is likewise slid over clip base 52 for additional tensioning of the cap fabric.

Tensioning handle 55 of article clamp 57 is closed on the inverted cap sweatband to help hold it on fabric frame 40 prior to embroidering. A second article clamp 58 (not shown) is also attached to first arcuate section 41 approximately 120° therefrom. Clip guide 63 insures proper alignment of clip 54 against the cap fabric.

Figure 7:
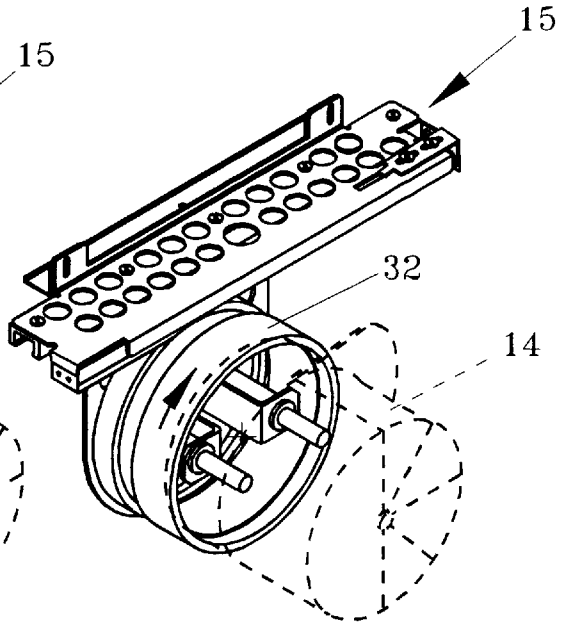
FIGS. 5–7 represent progressive orientations of drive system 15 as occur during the embroidering process with a cap in dashed lines.
Figure 6:
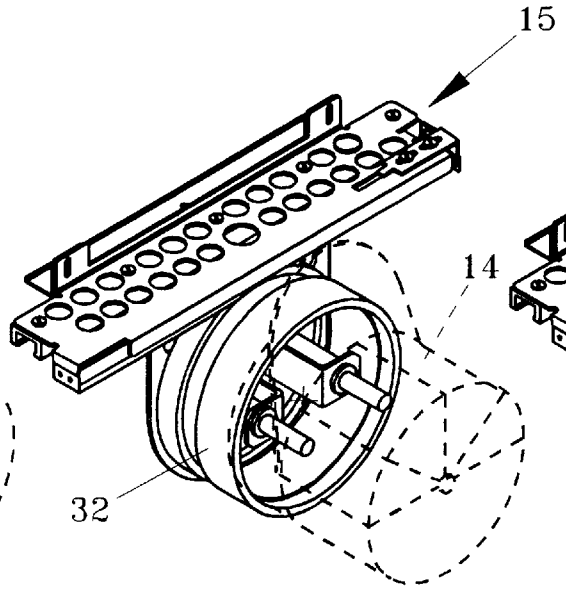
Figure 5:
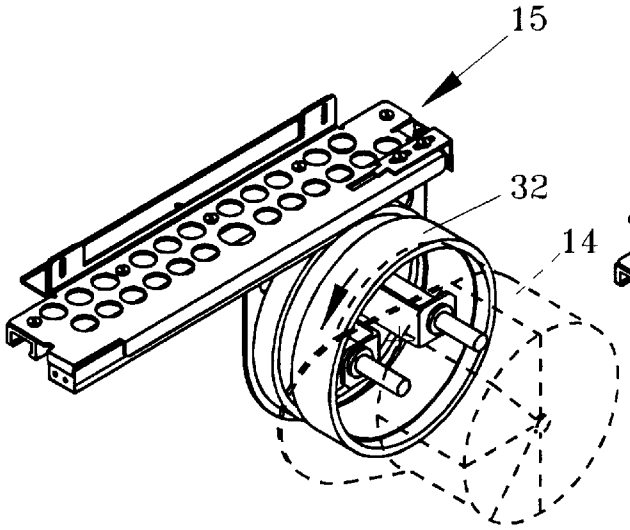

In FIGS. 5, 6 and 7, the longitudinal, rotational motion of frame drive cylinder 32 is shown with cap 14 shown in dashed lines. (Cap frame 40 has been removed for clarity). In FIG. 5, the bill of cap 14 is pointed to the left for embroidering on the left side of cap 14. As frame drive cylinder 32 rotates clockwise, as shown in FIG. 6, the cap bill is now substantially vertically disposed for embroidering along the front of cap 14. In FIG. 7, the clockwise rotational movement is complete and the bill of cap 14 is now pointed to the right for embroidery on the opposite side of cap 14 from that shown in FIG. 5. About 270° rotational motion is shown by cap 14 in FIGS. 5–7 which exceeds conventional cap frame movement on conventional embroidering machines, which generally only allow cap rotation of only about 90–120°. By taking full advantage of the rotation motion of the present invention, cap 14 can be rotated approximately 300°. Lateral motion in the Y direction can also occur during rotation as directed by the particular embroidering program utilized.

Figure 9:
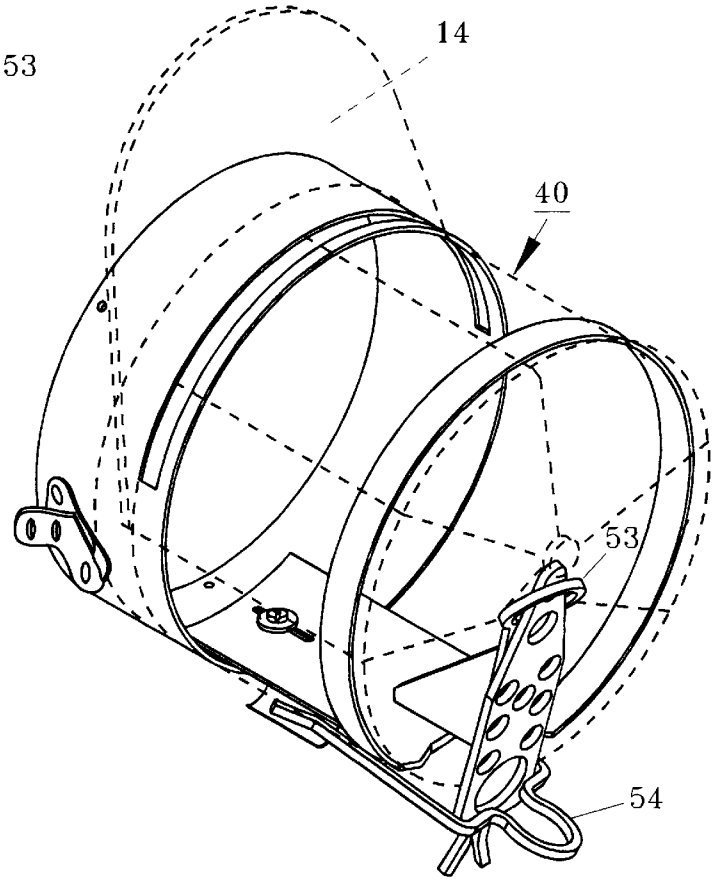
FIG. 9 shows the cap and frame as in FIG. 8 but with the cap fabric tightened by the gathering clips.
Figure 8:
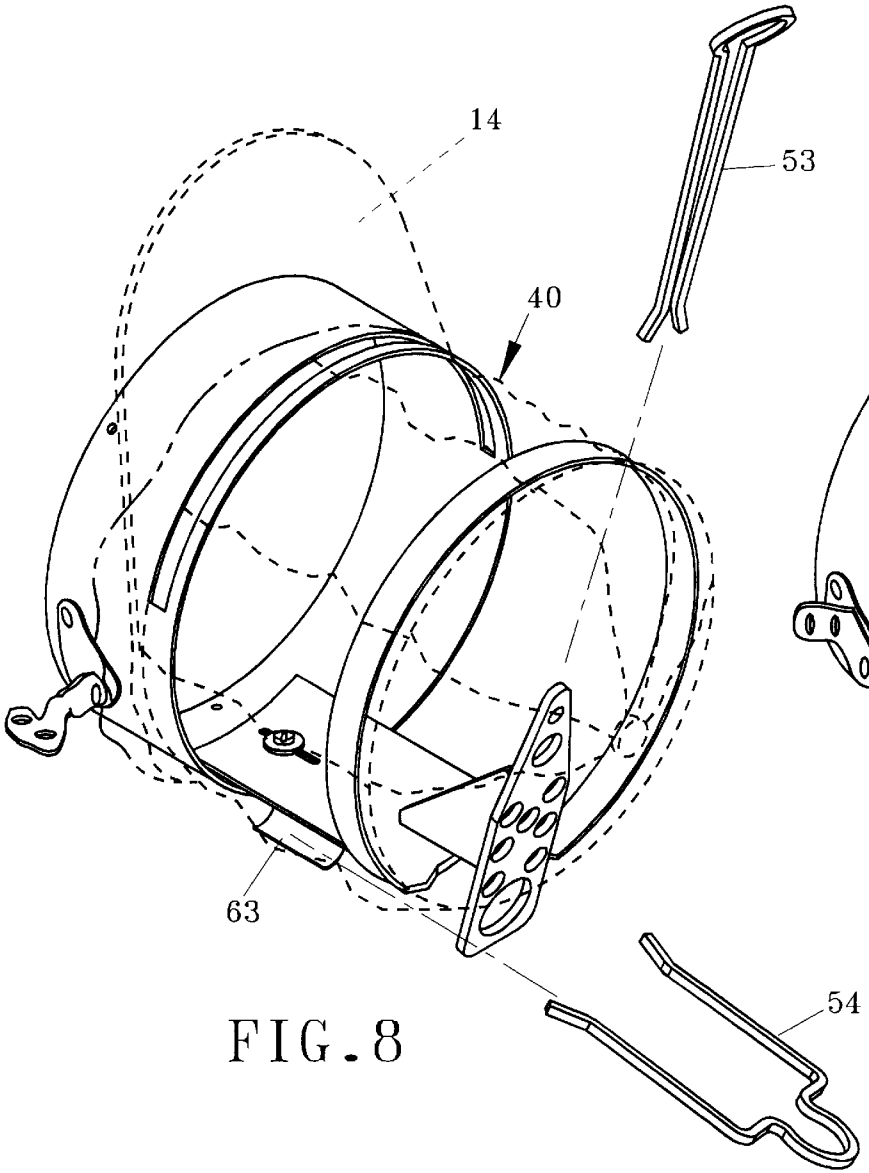
FIG. 8 illustrates the fabric frame with a cap in dashed lines initially placed thereon.

In FIG. 8, cap 14 is shown in dashed lines to demonstrate its initial placement on sewing frame 40 with the fabric somewhat loose. As would be understood, loose fabric may create improper registration during embroidering. To remedy the problem, gathering clips 53, 54 are urged onto the cap fabric over clip 52 to tighten the fabric and thus assure proper registration during embroidering as seen in FIG. 9.

The illustrations and examples provided herein are for explanatory purposes and are not intended to limit the scope of the appended claims.

I claim:

1. A frame for retaining a curved article comprising: a generally cylindrical first arcuate section, a depending extension, said depending extension slidably mounted on said first arcuate section, and a clip base, said clip base biasly attaches to said first arcuate section.

2. The frame of claim 1 further comprising means to releasably attach a fabric article, said releasable attaching means affixed to said first arcuate section.

3. A frame for retaining a curved article comprising: a generally cylindrical first arcuate section, a generally cylindrical second arcuate section, a depending extension, said depending extension mounted on said second arcuate section and slidably engaging and selectively affixed to said first arcuate section, and an article clamp, said article clamp mounted to said first arcuate section whereby said second arcuate section can be selectively, axially spaced from said first arcuate section by sliding said depending extension.

4. The frame of claim 3 further comprising a gathering clip, said gathering clip for engagement with said clip base.

5. The frame of claim 3 further comprising a plurality of article clamps, said plurality of article clamps mounted on said first arcuate section.

6. The frame of claim 3 wherein said clip base, is biasly attached to said second arcuate section.

7. The frame of claim 3 formed from metal.

8. A frame drive system for a sewing machine comprising: a mounting plate, a flexible band, said flexible band connected to said mounting plate, said flexible band defining a loop, a frame drive cylinder, said frame drive cylinder positioned within said loop for rotation along said mounting plate, a frame drive plate, said frame drive plate slidably joined to said mounting plate and affixed to said frame drive cylinder, said frame drive cylinder defining an interior race, a frame drive roller, and said frame drive roller mounted within said race.

9. The frame drive system of claim 8 wherein said frame drive cylinder comprises a polymeric material.

10. The frame drive system of claim 8 wherein said frame drive plate is affixed to said frame drive cylinder.

11. The frame drive system of claim 8 further comprising a lateral bushing, said lateral bushing attached to said frame drive plate.

12. The frame drive system of claim 8 further comprising a pair of lateral bushings, said pair of lateral bushings each attached to said frame drive plate.

13. The frame drive system of claim 8 further comprising a trio of frame drive rollers, said rollers mounted to said frame drive plate and said rollers in contact with said frame drive cylinder.

14. The frame drive system of claim 8 further comprising a locking mechanism, said locking mechanism attached to frame drive cylinder, said locking mechanism for releasably connecting a fabric frame.

15. The frame drive system of claim 14 further comprising a locking stud, said frame drive cylinder defining a locking stud aperture, said locking stud slidably mounted in said locking stud aperture, said locking stud for engagement with a fabric frame.

16. The frame drive system of claim 11 further comprising a slide rod, said lateral bushing mounted on said slide rod for movement therealong.

* * * * *